United States Patent [19]

Westerburgen

[11] Patent Number: 4,823,532

[45] Date of Patent: Apr. 25, 1989

[54] BUILDING ELEMENT AND COUPLING-PIN FOR INTERCONNECTING SUCH ELEMENTS

[75] Inventor: Joseph P.M. Westerburgen, Heythuysen, Netherlands

[73] Assignee: Cornelia P.M. Westerburgen, Netherlands

[21] Appl. No.: 928,399

[22] Filed: Nov. 10, 1986

[30] Foreign Application Priority Data

Nov. 14, 1985 [NL] Netherlands ..... 8503134

[51] Int. Cl.[4] ..... E04C 1/10

[52] U.S. Cl. ..... 52/594; 446/122; 446/128

[58] Field of Search ..... 52/590–595, 52/582, 585, 587; 446/122, 121, 128; 403/298

[56] References Cited

U.S. PATENT DOCUMENTS

| | | | |
|---|---|---|---|
| 2,885,822 | 5/1959 | Onanian | 446/121 |
| 3,611,609 | 10/1971 | Reijnhard | 446/121 |
| 4,516,364 | 5/1985 | Heider | 52/593 X |
| 4,551,110 | 11/1985 | Selvage et al. | 446/122 X |

FOREIGN PATENT DOCUMENTS

| | | | |
|---|---|---|---|
| 2446475 | 4/1976 | Fed. Rep. of Germany | 446/121 |
| 2239086 | 3/1975 | France | 446/121 |

*Primary Examiner*—Carl D. Friedman

*Attorney, Agent, or Firm*—James C. Wray

[57] ABSTRACT

A generally rectangular building element has projections on the top surface and matching recesses on the bottom surface. Apertures are provided in the projections so that coupling pins can be used to lock together building elements that are assembled together.

8 Claims, 3 Drawing Sheets

BUILDING ELEMENT AND COUPLING-PIN FOR INTERCONNECTING SUCH ELEMENTS

The invention relates to a rectangular building element, which at one side is provided with projections and at the opposite side with recesses, so that by arranging two elements one upon the other projections of the one element fit into recesses of the other element, which projections are provided with a central aperture, which is locally widened to interconnect the elements by means of a coupling-pin, which in operative position bears with its head upon a projection of the one element and snaps into the widening of the central aperture of a projection of the other element.

Such building elements are known as toy building elements from Dutch Patent Application 6800094. The projections prevent the relative sliding movements of the interconnecting elements and also provide to a certain extent a connection in a direction parallel to the projections, as projections or the one element are clamp-fitted in the recesses of the other element.

To increase this engagement the elements of the known construction can be interconnected by means of a coupling-pin. This coupling-pin is at the one end provided with a head and at the other end with elastic tongues, which are separated by longitudinal slits and provided with outwardly projecting lugs. The lugs fit into the widening of the central aperture, so that a snap connection is created, which can be uncoupled by drawing the pin out of the central aperture of drawing the building elements from each other. To enable this uncoupling without damage of the coupling-pins the lugs are bevelled at the outer side, so that the elastic tongues are forced inwardly when the pin is pulled out. This means in fact a limitation of the force by which the elements are held together.

It has already been proposed to apply similar elements, but larger in size then known as toys, for the construction of walls and of structures composed of walls. However, a snap connection is not strong enough for this application to obtain the desired strength of the connection in this case. To increase the strength of the interlocking engagement of the elements in this case, it is known to stuck them together (German Patent application No. 2,111,907) or to provide in a continuous opening in which after finishing the construction of a wall an armouring is inserted, after which the openings are filled with concrete (French Patent Specification No. 2,203,924). However, these constructions have the disadvantage that they cannot be dismounted without damaging the elements and that this dismounting absorbs much time.

It is the general object of the invention to provide a construction in which the building elements can be connected rapidly and firmly to each other and also, when necessary, be disconnected rapidly without the elements being damaged, so that they can be reused. It is therefore a specific object of the invention to provide building elements and coupling means for structures which frequently have to be built up and dismounted, such as exhibition stands and the like. The invention can furthermore be applied advantageously in houses, for erecting walls, dividers, etc., as well as in toy building elements, especially when these are larger in size than the elements normally used in toy building sets.

According to the present invention the circumferential wall of the widening is in cross-section undulated, whereby the inwardly directed crests are situated on lines, which constitute a continuation of the wall of the unwidened portion of the central aperture.

When two elements are interconnected by means of a coupling-pin, the lugs at the end of the pin will fit into the recesses formed by the wavetroughs in the corrugated wall of the widening. Dismounting of the coupling-pin is obtained by turning the pin so far until the studs are situated upon the wavecrests of the corrugated wall. As these crests are situated on lines which are aligned with the wall of the central aperture, the pin can be drawn out of the aperture without much trouble and without damaging the building elements or the coupling-pin. The lines on which the wavecrests are to be found are normally a continuation of the wall of the central aperture. They can however also be situated on lines which are angled with respect to the axis of the aperture or are curved, if they fulfill the condition that they link up with the wall of the aperture.

In the known construction, dismounting of the pin is effected by exerting an axial force on it. The lugs of the coupling-pin must have a special shape in this case, which makes a strong connection between two elements impossible. By applying the corrugated wall according to the invention the dismounting of the coupling pin takes place by turning the pin over a small angle after which the pin can be removed without any trouble. This makes it possible to use coupling-pins with lugs in the form of a hook. A hooklike lug is a lug, the upper surface of which is lying substantially perpendicular to the axis of the pin. A coupling-pin with hooklike lugs cannot be drawn without more out of the aperture when the lugs are situated in the widening. By using the building elements according to the invention it therefore becomes possible to obtain a very strong interconnection between two elements stacked one upon another. In a suitable embodiment the wall of the widening is constituted by four curved surfaces, which are especially joined by a substantial flat wall portion.

Preferably the outer surface of the projections is identical and concentric with respect to the wall of the widening, and the flat wall portions joining the curved surfaces are parallel to the upstanding sides of the element.

The building elements can be made as a block with projections at the one side and corresponding recesses at the opposite side or as a box which is open at one side, the bottom of which is provided at the outside with projections arranged at the angular points of a square and at the inner side with studs, which are arranged in such a way, that when the elements are stacked one upon the other, the studs of the one element are clamped between the projections of the other element. In the embodiment according to the latter type the outer surface of the projections is preferably corrugated in such a way, that in the stacked position of the elements the projections of the one element embrace the studs of the other element. The studs are preferably circular in cross-section, whereas the facing curved surfaces of adjacent projections are arranged at a cylindrical or slightly conical plane which corresponds to the outer surface of the studs. In a preferred embodiment the studs are tubular and the longitudinal passage in the studs is locally narrowed by an inner collar. This enables the fastening of a wall built up of elements according to the invention with the help of anchoring bolts to the floor. This is only necessary for the lower elements, as the elements at a higher level are mutually rigidly connected by means of the coupling-pins. In known structures the anchoring bolts extend over the complete height of the wall.

It is a further object of the invention to provide a coupling-pin for connection building elements which are arranged upon each other, which coupling pin is provided at one end with a head and at the other end with elastic tongues which are separated by longitudinal slits and provided with outwardly projecting lugs. According to the invention the lugs in the coupling-pin are in the forms of a hook and the head has, corresponding to the projections of the element, the shape of a star, confined by four curved surfaces connected by substantial flat surfaces, whereby the tongues are situated below the points of this star. In coupled position the head will at no place protrude in lateral direction outside the circumferance of the projection, so that a next element only can be mounted when the coupling-pin of the underlying element is in its coupling position. The star-shape of the head provides a good grip on the head to turn the coupling-pin without the use of tools. When turning the pin one can feel when the lugs snap into the deepenings.

It is to be noticed that from Dutch Pat. No. 611,550 a connection element is known, in which by turning a pin the elastic tongues, provided with studs, which are provided at one end of the pin, are pressed inwardly. This is obtained by giving this end and the aperture in which the pin fits a square perimeter. The triangular studs, which can be used with this construction, can only be of small dimensions, as it must be possible to pull them through the small gaps which get clear in the corners of the square aperture when the pin is turned. With the embodiment of the invention, the shape and dimensions of the studs can be chosen more freely. Bearing in mind the mechanical characteristics of the material out of which the building elements are generally manufactured and the tolerances, which are maintained during the manufacture, it is clear that the use of small studs is unfitted for this purpose.

The invention will appear more clearly when taken in conjunction with the following description and the accompanying drawings showing an embodiment of the invention:

Figure 1:
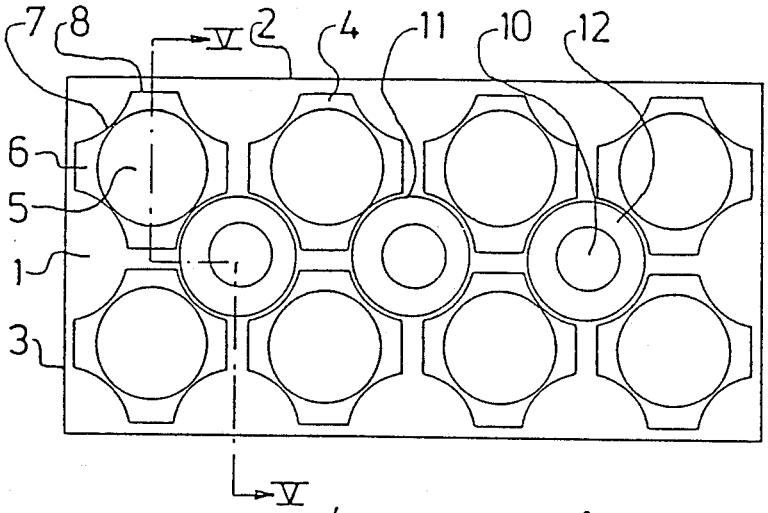
FIG. 1 is a top plan view of a rectangular building element according to the invention.
Figure 2:
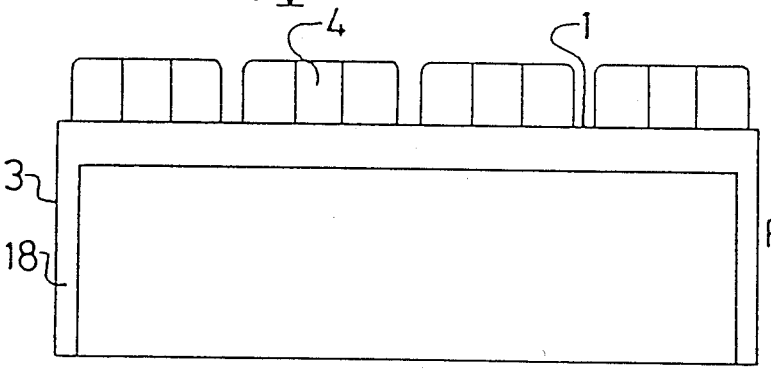
FIG. 2 is a side view of the longer side of this element.

The building element shown in the drawings consists of a rectangular bottom 1, two long parallel side walls 2 and two short parallel side walls 3. The outer side of the bottom is provided with two rows of projections 4, which are arranged at the angular points of a square and at an equal distance from the central line of the bottom. The projections are provided with a central aperture 5, which is provided with a collar 6 projected inwardly at the end of the projections. The wall of the projections is built up by four arcs 7 of a circle, which are joined by flat wall portions 8. The facing arcs of adjacent projections are situated in a circle, the diameter of which is substantially equal to that of the studs 9 provided at the inner side of bottom 1.

Figure 3:
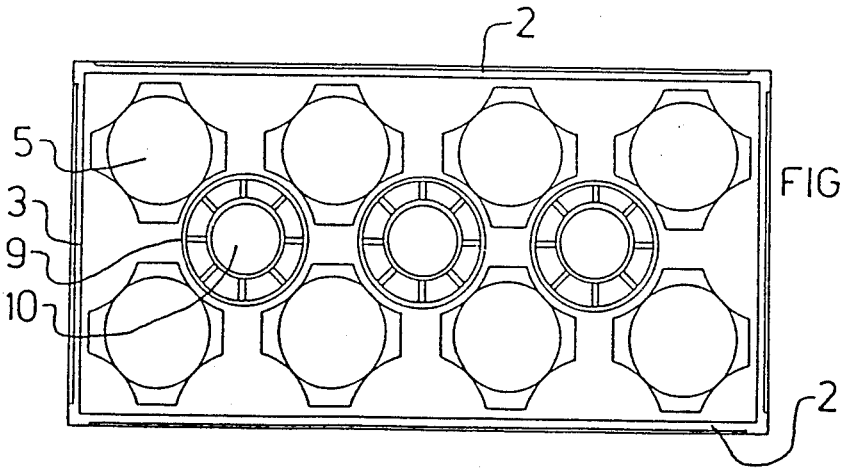
FIG. 3 is a bottom plan view of this element.
Figure 4:
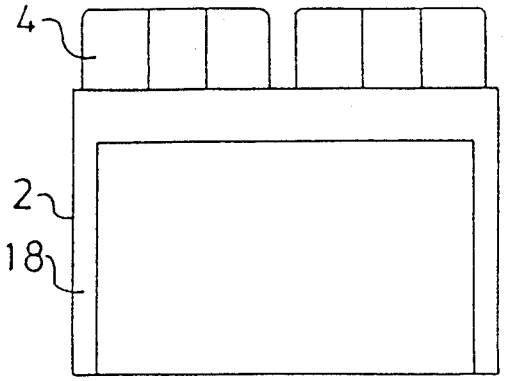
FIG. 4 is a side view of the shorter side of the element.
Figure 5:
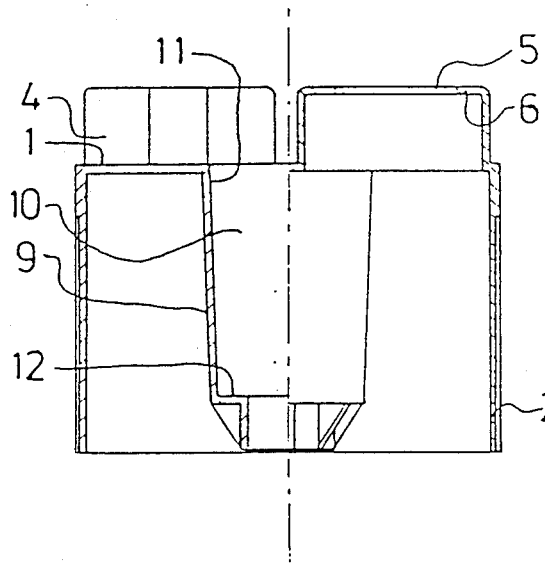
FIG. 5 is a cross-section taken in the direction of the line V—V in FIG. 1.
Figure 6:
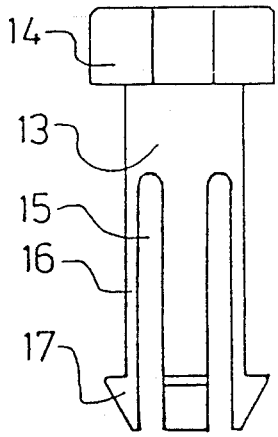
FIG. 6 is a side view of a coupling-pin according to the invention.
Figure 7:
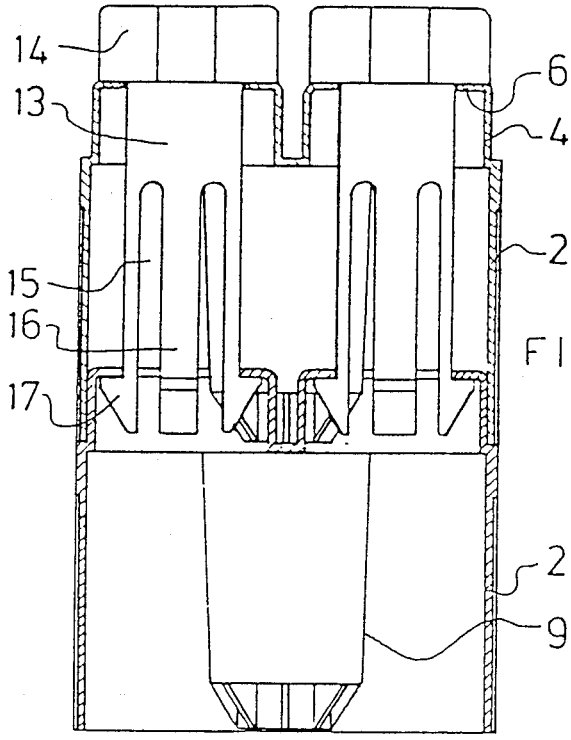
FIG. 7 is a cross-section of two interconnected elements.
Figure 8:
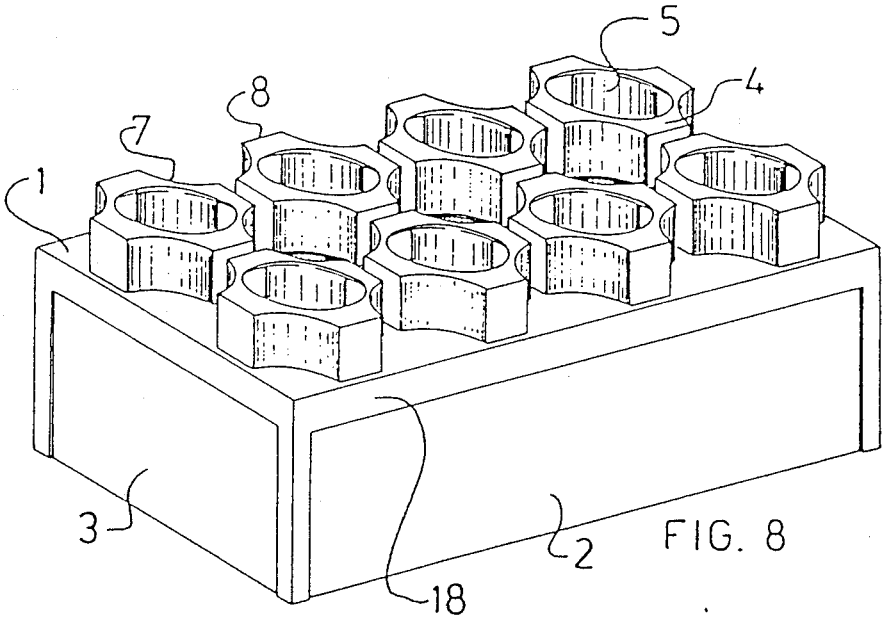
FIG. 8 is a perspective view of the building element.

The surface of the projections 4 at the inner side below the collar 6 is correspondingly formed by four arcs $7^1$ of a circle and flat wall portions $8^1$, as will be seen from the bottom plan view shown in FIG. 3. The arcs $7^1$ touch the wall of the aperture 5, whereas at the place of the flat wall portions $8^1$ a recess 19 is present below the collar 6. In this way a star-shaped widening is created, having a corrugated inner wall, the narrowest diameter of which as defined by the crests of the waves corresponds with the diameter of the aperture 5.

The studs are arranged with their longitudinal axis lying in the plane of symmetry parallel to the longer sides and have such a length, that when arranging the elements one upon the other, the ends of the studs of the one element penetrate between the projection of the other element. The studs are provided with a longitudinal passage 10, which debouches in an opening 11 in the bottom. At the opposite end the passage is narrowed by a collar 12 protruding inwardly. The lower elements of a structure can now be fastened to the floor by means of anchoring bolts and the like. The building element according to the invention is preferably fabricated by injectionmoulding of a crystalline or amorphous thermoplastic material. A crystalline polymer is polyethylene, polypropylene, nylon, polyacetate and mixtures thereof and an amorphous polymer polyvinylchloride, polystyrene, polycarbonate, acrylonitrile-butadien-styrene copolymer (ABS), rubberlike copolymers, etc. Furthermore foamed plastics can be applied and suitable fillers and pigments added.

The elements stacked upon one another can be interconnected by means of a coupling-pin 13. This pin is provided with a head 14 the shape of which corresponds to the outer shape of the projections 4. The pin has a circular cross-section of such a diameter that it can be introduced into the central aperture 5 of the projections. The lower end of the pin is provided with four diametrical opposed slits 15, so that four tongues 16 are formed. The tongues are at their ends provided with outwardly projecting lugs 17. The tongues and their lugs are positioned under the flattened points of the starshaped head of the pin. The length of the pin measured between the lower side of the head and the upper side of the lugs corresponds to the height of the side walls of the element. The lugs are hooked-shaped, i.e. the upper surface of the lugs is flat and directed substantially perpendicular to the longitudinal axis of the pin, whereas the dimension of the lug in this direction is sufficiently large to fulfill the conditions for a good functioning of a hook.

The pin is preferably manufactured from an elastic material, for example a thermoplastic material, such as nylon.

When two elements arranged one upon the other have to be connected with each other a coupling-pin is pushed into the central aperture of one of the projections of the upper element until the head rests upon the surface of this projection. Subsequently the pin is turned so far until the lugs snatch below the collar of the projections of the lower element into the recesses at the place of the wavetroughs of the corrugated wall. After that the pins cannot be drawn out of the apertures. When the elements have to be disconnected the pin is turned so far, that the lugs are situated upon the wavecrests of the wall. As the wall at this place coincides with the wall of the aperture 5, the pin can now be drawn out of the aperture. In this way a strong connection is obtained, which quickly can be mounted or dismounted and whereby only a single coupling-pin is sufficient to interconnect two elements. Apertures which are not used for the coupling of elements can be used for passing conduits through the structure, such as electrical wiring.

The distance between two flat wallportions of two adjacent projections is at least equal to twice the thickness of the side walls of the elements, so that the elements, if desired, can be stacked in bond. Beside the projections at least so much space is present, that an element can be placed with its open side down over the projections of another element.

Normally it is sufficient that an element is provided with two rows of projections 4 and one row of studs 9, as shown in the drawings. However, other configurations are possible, i.e. one row of projections and two rows of studs studs. The number of projections in a row depends upon the length of the element. For a smooth finish of the ends of a wall built up by means of the present building elements it may be necessary to use at one or more places a square element. Such an element may have four projections at the outside and a central stud at the inside.

The upstanding side walls 2 and 3 are at the upper side and the lateral sides provided with a narrow border 18, which serves to close the slit between two adjacent elements completely.

If desired a coverplate may be mounted on top of a wall structure built up by applying the invention, to hide the projections of the upper row of elements and the heads of the coupling-pins from view.

I claim:

1. A rectangular building element having a box-like shape and which is open at one side, a top of the building element being provided at an outside with projections and at an inner side with studs, which are arranged in such a way, that when the elements are stacked one upon the other, the studs of the one element are clamped between the projections of the other element, whereby the projections are provided with a central aperture, wherein the central aperture comprises a top round opening and walls which are locally widened allowing connection of both elements by means of a coupling-pin having a head at the one end and hook-like lugs at the other end and which in operative position rests with its head on a projection of the one element and snaps with its lugs in the widening of the central aperture of the projection of the other element and further characterized in that the locally widened walls of the central aperture have an undulated cross section with inwardly directed crests, the top of which constitute a local continuation of the top round opening of the central aperture.

2. Building element according to claim 1, characterized in that the studs are tubular and a distal end of said studs is locally narrowed by an inner collar.

3. Rectangular building element, which at one side is provided with projections and at the other side with recesses, such that, by arranging two elements one upon each other, the projections of the one element fit into recesses of the other element and whereby the projections are provided with a central aperture, wherein the central aperture comprises a top round opening and walls which are locally widened allowing connection of both elements by means of a coupling-pin having a head at the one end and hook-like lugs at the other end and which in operative position rests with its head on a projection of the one element and snaps with its lugs in the widening of the central aperture of the projection of the other element and further characterized in that the locally widened walls of the central aperture have an undulated cross-section with inwardly directed crests, the top of which constitute a local continuation of the top round opening of the central aperture.

4. Building element according to claim 3, characterized in that the undulated wall of the central aperture is constituted by four curved surfaces, which form the inwardly directed crests and which are joined by a substantial flat wall portion.

5. Building element according to claim 4, characterized in that the flat wall portions are parallel to the upstanding sides of the element.

6. Building elements according to claim 3, including a connector pin, said pin having a head at the one end, and tongues separated by longitudinal slits at the other end, which tongues are provided at their outer ends with outwardly extending hooklike lugs with a flat upper surface which is substantially perpendicular to the longitudinal axis of the pin and wherein the head has the shape of a star confined by four curved surfaces connected by substantial flat surfaces.

7. Building element according to claim 1, characterized in that an outer surface of the projections is constituted by four curves surfaces, joined by a substantial flat wall portion.

8. Building element according to claim 7, characterized in that the studs have a circular cross-section, while the curved outer walls of the outer surfaces of the projections are arranged along a cylindrical or slightly conical plane, corresponding with the outer surface of the studs.

* * * * *